US007843288B2

(12) United States Patent
Lee et al.

(10) Patent No.: US 7,843,288 B2
(45) Date of Patent: Nov. 30, 2010

(54) APPARATUS AND SYSTEM FOR TRANSMITTING POWER WIRELESSLY

(75) Inventors: Dong-hyun Lee, Seongnam-si (KR); Kyung-ho Park, Suwon-si (KR); Wee-sang Park, Pohang-si (KR); Jae-hee Kim, Pohang-si (KR); Sung-jin Muhn, Pohang-si (KR); Dae-woong Woo, Pohang-si (KR)

(73) Assignees: Samsung Electronics Co., Ltd., Suwon-si (KR); Postech Academy-Industry Foundation, Pohang-si (KR)

( * ) Notice: Subject to any disclaimer, the term of this patent is extended or adjusted under 35 U.S.C. 154(b) by 116 days.

(21) Appl. No.: 12/112,287

(22) Filed: Apr. 30, 2008

(65) Prior Publication Data

US 2009/0128262 A1 May 21, 2009

(30) Foreign Application Priority Data

Nov. 15, 2007 (KR) ..... 10-2007-0116901
Dec. 27, 2007 (KR) ..... 10-2007-0138983

(51) Int. Cl.
*H01P 7/10* (2006.01)

(52) U.S. Cl. ..... 333/219.1; 343/700 MS

(58) Field of Classification Search ..... 333/219.1, 333/230, 202; 343/700 MS
See application file for complete search history.

(56) References Cited

U.S. PATENT DOCUMENTS

| | | | | |
|---|---|---|---|---|
| 4,812,791 | A | 3/1989 | Makimoto et al. | |
| 5,608,771 | A | 3/1997 | Steigerwald et al. | |
| 5,940,036 | A * | 8/1999 | Oliver et al. | 343/700 MS |
| 6,774,744 | B1 * | 8/2004 | Hattori et al. | 333/134 |
| 6,960,968 | B2 | 11/2005 | Odendaal et al. | |
| 2002/0003461 | A1 * | 1/2002 | Hunter | 333/219.1 |

FOREIGN PATENT DOCUMENTS

| | | |
|---|---|---|
| JP | 5-249215 | 9/1993 |
| JP | 7-50503 | 2/1995 |
| JP | 9-214217 | 8/1997 |
| JP | 2000-321344 | 11/2000 |
| JP | 2002-290118 | 10/2002 |
| KR | 2000-0015813 | 3/2000 |
| KR | 2001-0021086 | 3/2001 |

* cited by examiner

*Primary Examiner*—Benny Lee
(74) *Attorney, Agent, or Firm*—NSIP Law

(57) ABSTRACT

An apparatus for transmitting power wirelessly is provided. The apparatus comprises: a dielectric resonator which generates evanescent waves in a predetermined direction in order to transmit power; and a loop antenna which is coupled to a surface of the dielectric resonator and supplies power to the dielectric resonator. The dielectric resonator transmits power by means of evanescent waves generated in directions perpendicular to top and bottom surfaces of the dielectric resonator and by radiation in directions parallel to the top and bottom surfaces of the dielectric resonator. Accordingly, efficient power transmission over short and long distance ranges is possible.

17 Claims, 10 Drawing Sheets

APPARATUS AND SYSTEM FOR TRANSMITTING POWER WIRELESSLY

CROSS-REFERENCE TO RELATED APPLICATIONS

This application claims priority from Korean Patent Application Nos. 10-2007-00116901 and 10-2007-0138983, respectively, filed on Nov. 15, 2007 and Dec. 27, 2007, the disclosures of which are incorporated herein in its entirety by reference.

BACKGROUND OF THE INVENTION

1. Field of the Invention

The present invention relates to a power transmitting apparatus, and more particularly, to an apparatus and a system for transmitting and receiving power wirelessly.

2. Description of the Related Art

Recently, wireless power transmission technology that can wirelessly provide power to a variety of mobile devices or industrial robots has become an issue. Inductive coupling and radiative coupling are typically used for wireless power transmission.

In inductive coupling, a number of coils are used such that a magnetic field is strongly induced in one direction, and when coils which resonate at a similar frequency become very close to each other, coupling takes place, and power transfer thereby occurs between the coils. However, the inductive coupling enables power transfer within a very limited range, and power transfer is not possible if the coils are not accurately aligned with each other.

In contrast, in radiative coupling, antennas such as a monopole or a planar inverted F antenna (PIFA) are used to radiate power while time varying electric fields and magnetic fields interact with each other. If two antennas have the same frequency, power can be transferred between the antennas according to the polarization properties of an incident wave. However, in this case, power is radiated in all directions, and thus efficient power transmission is hard to be achieved.

SUMMARY OF THE INVENTION

The present invention provides a wireless power transmitting apparatus and a wireless power transmitting and receiving system which over a short distance range have higher power transmission efficiency than the power transmission efficiency of a radiative coupling method and can transmit power over a longer distance than in an inductive coupling method.

Additional aspects of the invention will be set forth in the description which follows, and in part will be apparent from the description, or may be learned by practice of the invention.

The present invention discloses an apparatus for transmitting power wirelessly, the apparatus comprising: a dielectric resonator which generates evanescent waves in a predetermined direction in order to transmit power; and a loop antenna which is coupled to a surface of the dielectric resonator and supplies power to the dielectric resonator.

The dielectric resonator may generate evanescent waves in directions perpendicular to top and bottom surfaces of the dielectric resonator in order to transmit power. The dielectric resonator may perform power transmission by radiation in directions parallel to the top and bottom surfaces of the dielectric resonator. The dielectric resonator may transmit relatively more power to a power receiving apparatus using evanescent waves than radiation when the dielectric resonator is within a predetermined range of distance from the power receiving apparatus and may transmit relatively more power by radiation than by evanescent waves when a distance of the dielectric resonator from the power receiving apparatus exceeds the predetermined range.

The present invention also discloses an apparatus for receiving power wirelessly, the apparatus comprising: a dielectric resonator which receives evanescent waves generated in a predetermined direction using a dielectric in order to receive power; and a loop antenna which is coupled to a surface of the dielectric resonator and receives power from the dielectric resonator.

The present invention also discloses a system for transmitting and receiving power wirelessly, the system comprising: a power transmitting apparatus which includes a dielectric resonator and a loop antenna and transmits power provided from the loop antenna to a power receiving apparatus using evanescent waves generated by the dielectric resonator; and the power receiving apparatus which includes a dielectric resonator that receives the power using the evanescent waves generated by the power transmitting apparatus and a loop antenna that transmits the received power to an external device, wherein each of the power transmitting apparatus and the power receiving apparatus is formed by the dielectric resonator and the loop antenna which are coupled to each other.

The power transmitting and receiving efficiency may increase as resonant frequencies of each dielectric resonator of the power transmitting apparatus and the power receiving apparatus become closer to each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the aspects of the invention.

DETAILED DESCRIPTION OF EXEMPLARY EMBODIMENTS

The invention is described more fully hereinafter with reference to the accompanying drawings, in which exemplary embodiments of the invention are shown. Hereinafter, in describing the present invention, detailed descriptions of relevant functions or structures well-known to those skilled in the art will be omitted when it is considered that the descriptions obscure the point of the present invention. The terms used herein are defined in consideration of the functions of elements in the present invention, and may be varied according to the intentions or the customs of a user and an operator.

Figure 1A:
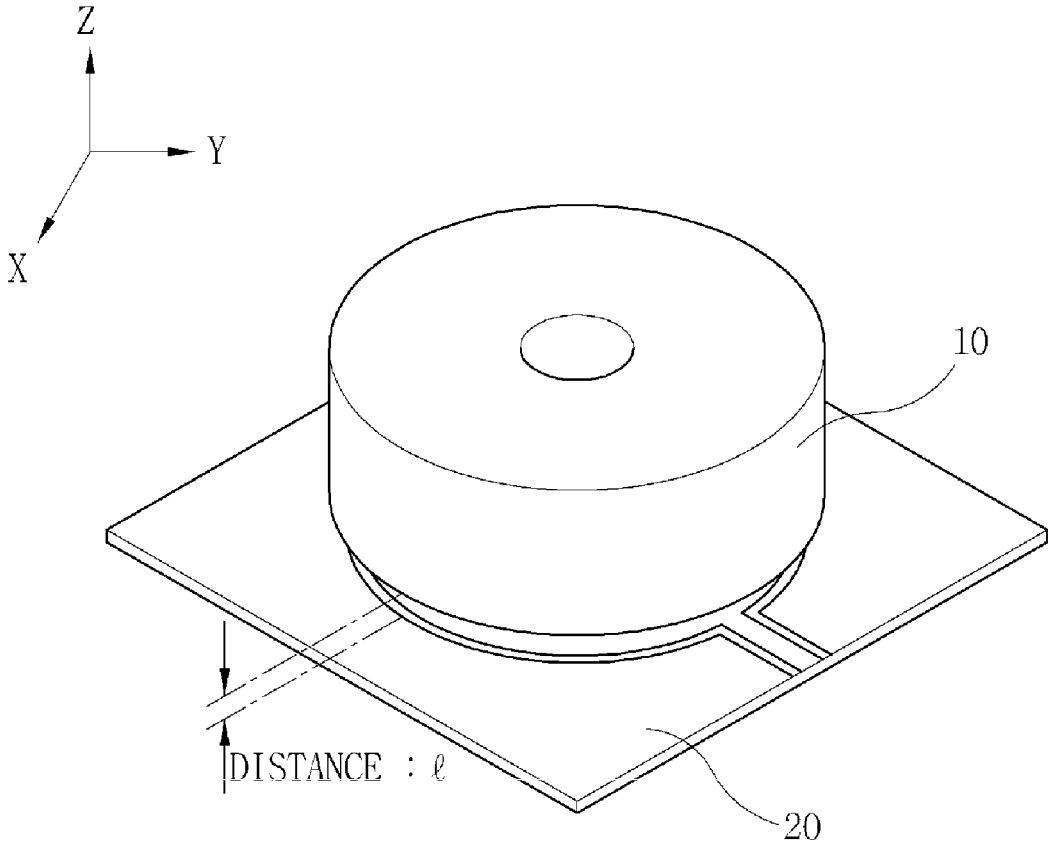
FIGS. 1A to 1C illustrate structures of a wireless power transmitting apparatus according to an embodiment of the present invention.
Figure 1B:
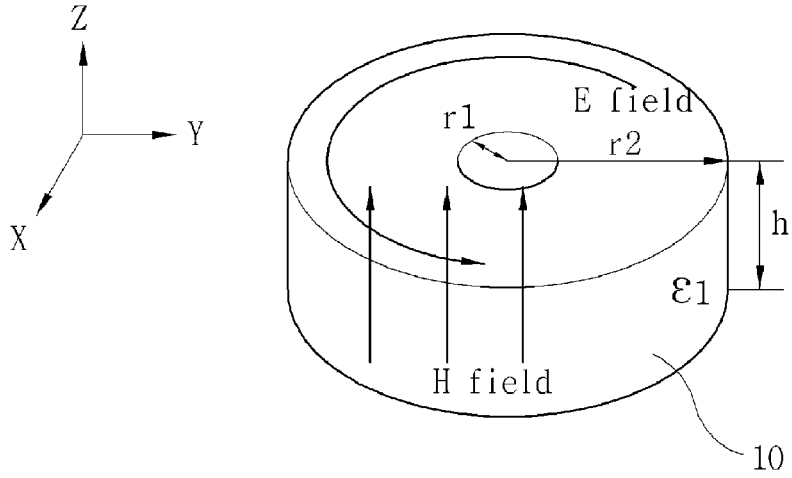
Figure 1C:
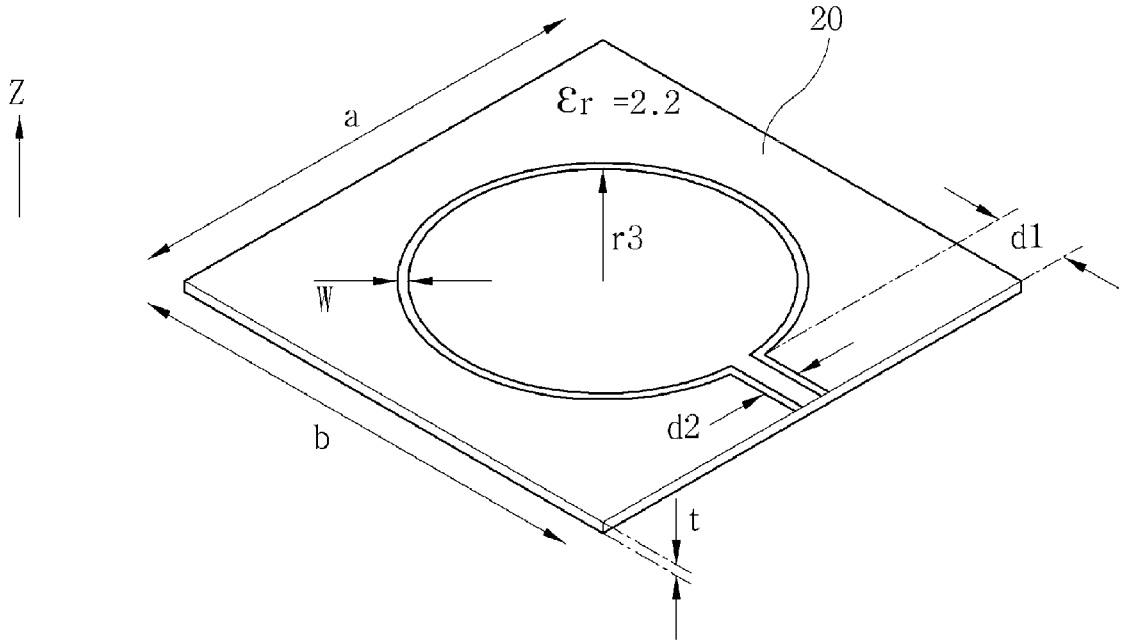

FIGS. 1A to 1C illustrate structures of a wireless power transmitting apparatus according to an embodiment of the present invention.

A short-distance wireless power transmitting apparatus employed by the present invention is a dielectric resonator antenna. FIG. 1A shows the entire dielectric resonator antenna, FIG. 1B shows a structure of a dielectric resonator 10 and magnetic and electric fields, and FIG. 1C shows a loop antenna 20 of a power supply structure for providing power to the dielectric resonator 10 (e.g. see FIGS. 1A & 1B).

Referring to FIG. 1A, the wireless power transmitting apparatus includes the dielectric resonator 10 and the loop antenna 20. In FIG. 1A, X, Y, and Z are directions of 3 dimension space, and 1 is a distance from the dielectric resonator 10 to loop antenna 20. The dielectric resonator 10 generates an evanescent wave in a particular direction using a dielectric so as to transmit power. The evanescent wave produces a strong field near the dielectric resonator 10, and the intensity of the evanescent wave decays exponentially with the distance from the dielectric resonator 10.

Due to the structural characteristic of the dielectric resonator having a high dielectric constant, resonance occurs in the dielectric resonator 10 and a cutoff mode is generated outside of the dielectric resonator 10 so that an evanescent wave is formed. The radiation spreads in all directions from the side of the dielectric resonator 10. By using these characteristics of the dielectric resonator 10, power is transmitted using evanescent waves, which are formed in directions perpendicular to the top and bottom surfaces of the dielectric resonator 10, or is transmitted in a direction parallel to the top and bottom surfaces of the dielectric resonator 10 through radiation.

The dielectric resonator may transmit relatively more power to a power receiving apparatus within a predetermined range of distance using evanescent waves and may transmit relatively more power by radiation when a distance from the power receiving apparatus exceeds the predetermined distance range.

The structure of the dielectric resonator 10, which forms the wireless power transmitting apparatus according to the present embodiment of the present invention, will now be described in detail. FIG. 1B shows the structure of the dielectric resonator 10 and electric and magnetic fields around the dielectric resonator 10. Although a cylinder type dielectric resonator is employed in the present embodiment, the present invention is not limited thereto, and various types of dielectric resonators are available.

The dielectric resonator 10 forms a TE016 mode, and a magnetic field (H field) is formed in a direction z. The direction of the H field is the same as a direction of a magnetic field in a power supply structure employing the loop antenna 20, which will be described later, thereby enabling the power supply using the loop antenna 20. When resonance occurs in the dielectric resonator 10, a cutoff mode is formed in the direction z so that evanescent waves are created and the radiation spreads in directions x and y.

Table 1 shows parameter values for designing a dielectric resonator which operates at a frequency of 835 MHz. Referring to the example dielectric resonator of FIG. 1B, r1 is a distance from the center of the cylindrical dielectric resonator 10 to an inner bound of the dielectric resonator 10, r2 is a distance from the center of the cylindrical dielectric resonator 10 to an outer bound of the cylinder type electric resonater 10, h is a height of the cylindrical dielectric resonator 10, the E field is electric field, the H field is magnetic field and ∈1 is dielectric constant of the dielectric resonator 10.

TABLE 1

| Symbol | Parameter value (mm) |
|---|---|
| r1 | 8 |
| r2 | 31 |
| h | 23 |

However, a design of the dielectric can be modified in various ways according to a desired frequency at which the resonator operates or characteristics of a terminal having wireless power transmission and receipt functions. Hence, the parameter values can be varied according to the intentions of a user.

FIG. 1C illustrates an exemplary embodiment of the loop antenna 20. The loop antenna 20 forms coupling with a side of the dielectric resonator 10 so as to supply power to the dielectric resonator 10. As shown in FIG. 1A, the loop antenna 20 is separate by a predetermined space from the side of the dielectric resonator 10, and when power is applied to the loop antenna 20, an electromagnetic field is excited in the dielectric resonator 10 to provide power to the dielectric resonator 10.

The loop antenna 20 may be a micro-strip antenna which is formed by patterning a loop-shaped antenna on a substrate. The power supply structure for exciting an electromagnetic field is formed in a loop shape, and a micro-strip structure is employed to improve the precision of fabrication and facilitate coupling between the loop antenna 20 and the dielectric resonator 10. However, the present invention is not limited to the loop antenna described above, and various modified forms of antenna can be used, for example, using a loop-shaped antenna as it is.

Table 2 shows design parameters of the power supply structure using the loop antenna 20. In the example shown in FIG. 1C, d1 is the length of straight line of loop antenna in a loop shape, d2 is the distance between the two straight lines of loop antenna in a loop shape, and t is the thickness of a loop antenna 20. Also, ∈r 2.2 is the dielectric constant of the loop antenna 20.

TABLE 2

| symbol | measurement (mm) | symbol | measurement (mm) |
|---|---|---|---|
| a | 62 | d1 | 13 |
| b | 66 | d2 | 4 |
| w | 1 | t | 1.55 |
| r3 | 17 | | |

However, a shape of the loop antenna 20 can be varied according to a desired frequency or a terminal having wireless power transmission or receipt function. Therefore, the parameter values shown in Table 2 can be changed according to the intentions of a user.

The loop antenna 20 has a magnetic field "H field" formed perpendicular to a loop plane, and a resonant frequency may be in an UHF, HF, or LF band according to a desired frequency, or characteristics of a terminal having a wireless power transmission or receipt function. As described above, the dielectric resonator 10 has a magnetic field formed in a direction z in a TE016 mode, and the direction of the magnetic field of the dielectric resonator 10 is the same as that of the magnetic field of the power supply structure, thereby enabling the power supply using the loop antenna 20.

As shown in FIG. 1A, a distance between the dielectric resonator 10 and the loop antenna 20 can be adjusted. According to the current embodiment of the present invention, the distance 'I' between the dielectric resonator 10 and the loop antenna 20 is 3 mm. However, the present invention is not limited thereto, and a distance between the dielectric resonator 10 and the loop antenna 20 may be varied according to a desired frequency, or characteristics of a terminal having a wireless power transmission or receipt function. Thus, the parameter values described above can be changed according to the intentions of a user.

Figure 2A:
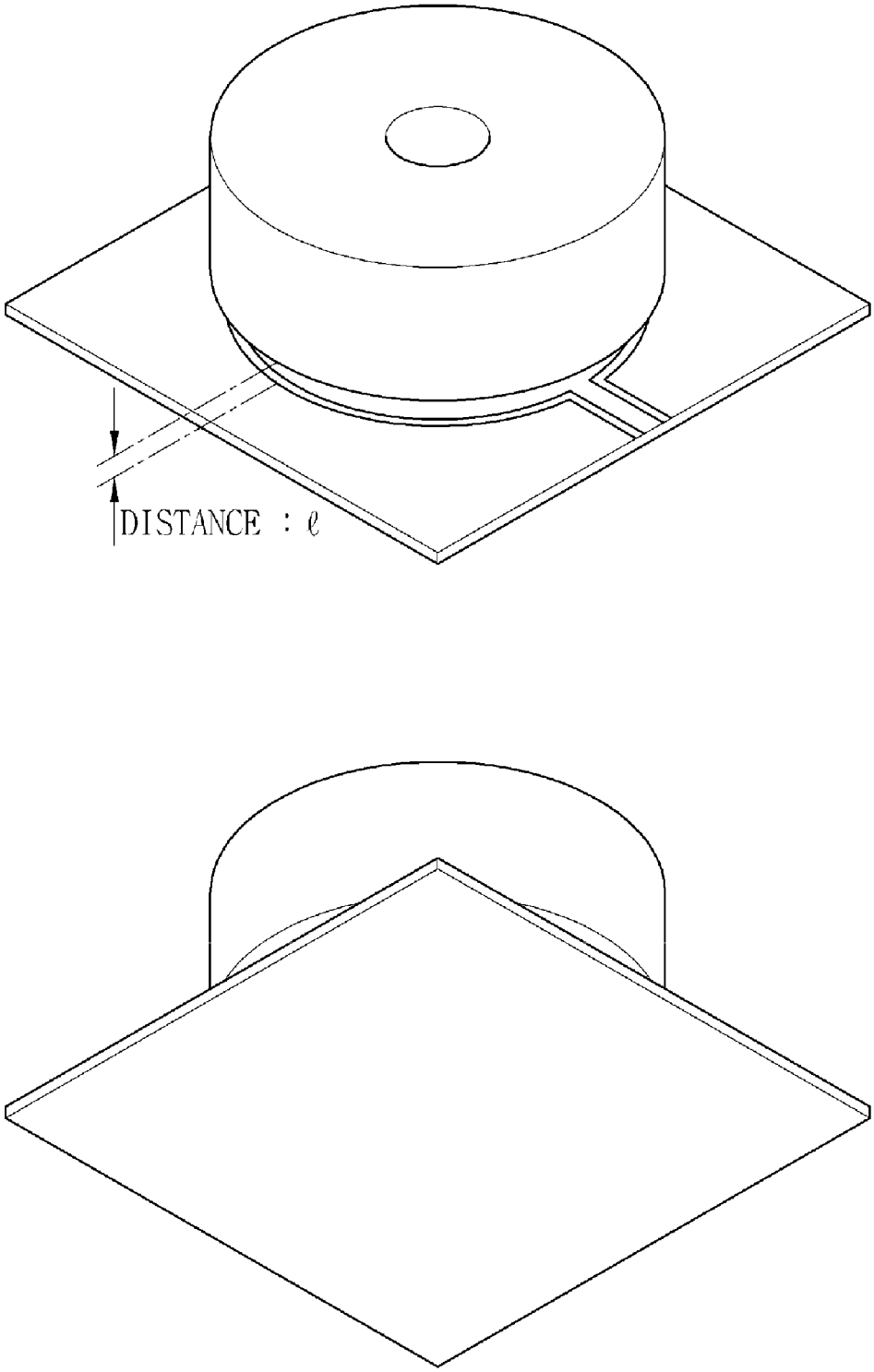
FIGS. 2A and 2B illustrate exemplary embodiments of structures of a wireless power transmitting apparatus according to an embodiment of the present invention.
Figure 2B:
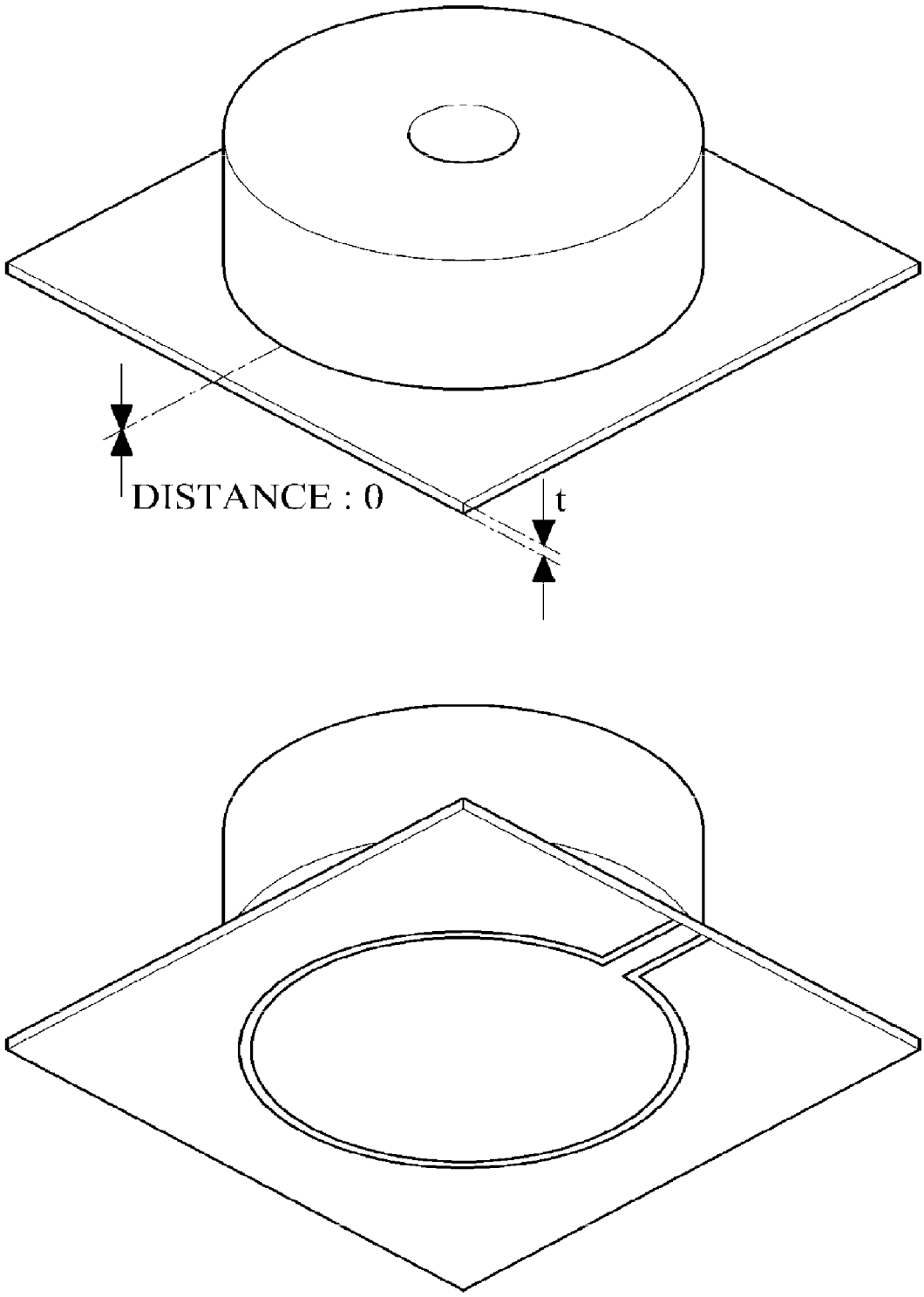

FIGS. 2A and 2B illustrate exemplary embodiments of structures of a wireless power transmitting apparatus according to an embodiment of the present invention. Referring to FIG. 2A, a surface of a substrate on which a loop-shaped antenna is patterned, may be coupled to a surface of a dielectric resonator with an insulating layer interposed therebetween. A substrate having insulating properties, or insulation, such as STYROFOAM®, may be used as the insulating layer to adjust the distance between the surface of the dielectric resonator and the substrate with a loop-shaped antenna patterned thereon to form an electromagnetic field. A distance between the dielectric resonator 10 and a substrate of the loop antenna 20 is l, and a distance between the dielectric resonator 10 and a loop becomes l. According to the current embodiment of the present invention, the distance l is 3 mm, but the present invention is not limited thereto, and various modifications of the design are possible.

Also, as shown in FIG. 2B, according to another exemplary embodiment of the present invention, a surface opposite to the surface on which a loop-shaped antenna is patterned contacts a surface of the dielectric resonator 10 to form coupling therebetween. The thickness of the substrate of the loop antenna 20 is appropriately set and a loop is patterned on the rear of the substrate, and a distance between the dielectric resonator and the loop antenna can be adjusted without an additional structure. In this case, the distance between the dielectric resonator and the surface of the loop antenna is 0 and the distance between the dielectric resonator and the loop becomes the thickness t of the substrate. In the current embodiment of the present invention, the thickness t of the substrate is 1.55 mm, but the present invention is not limited thereto, and various modifications of the design are possible.

Figure 3A:
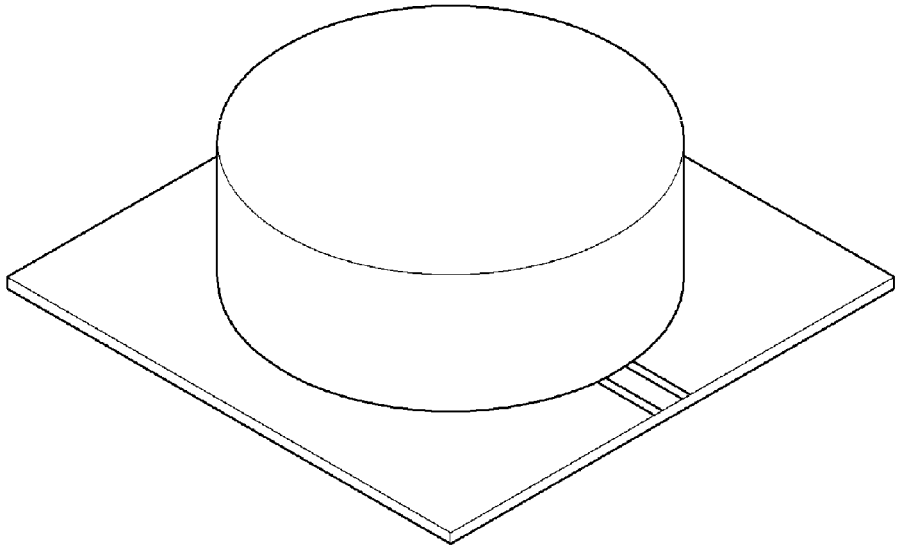
FIGS. 3A to 3E illustrate various modifications of a wireless power transmitting apparatus according to embodiments of the present invention.
Figure 3B:
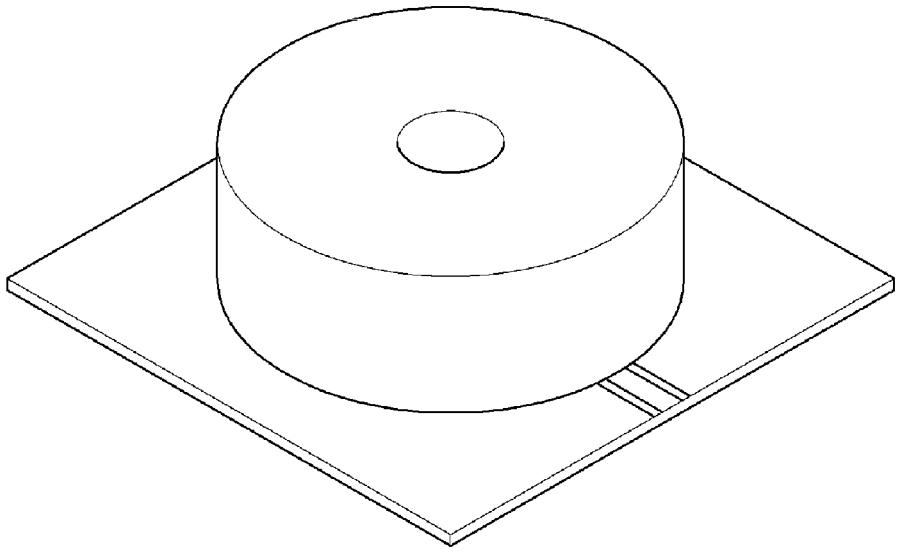
Figure 3C:
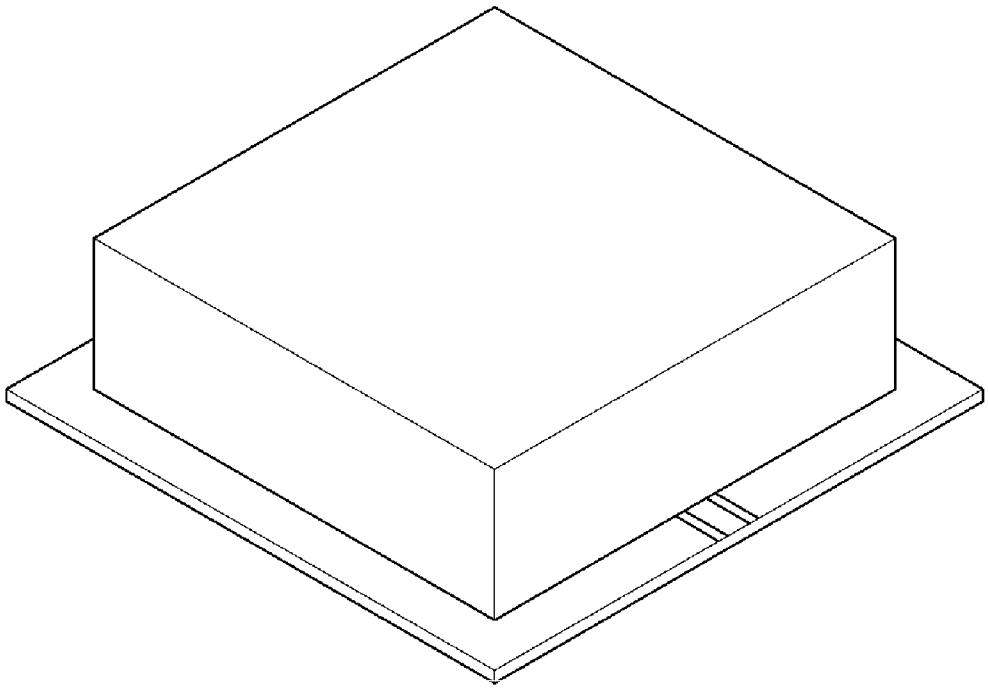
Figure 3D:
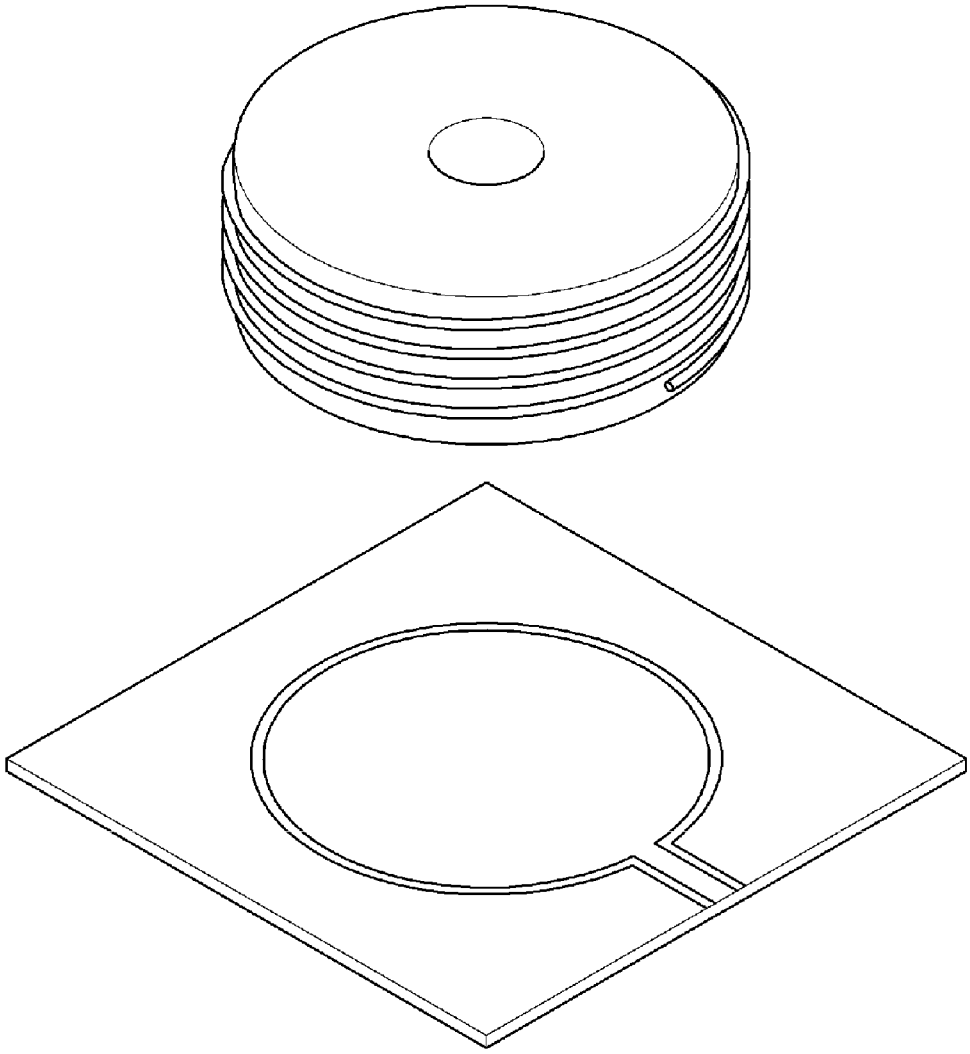
Figure 3E:
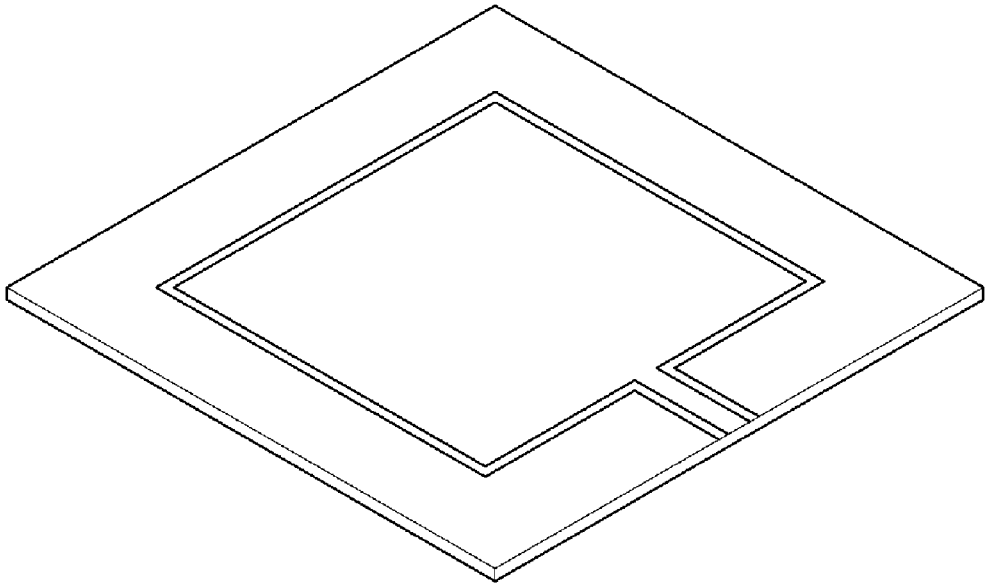

FIGS. 3A to 3E illustrate various modifications of a wireless power transmitting apparatus according to embodiments of the present invention. A variety of shapes of a dielectric resonator can be used, for example, a shape of a cylinder (referring to FIG. 3A), a shape of a cylinder with a hole in the center (referring to FIG. 3B), and a shape of a rectangular parallelepiped (referring to FIG. 3C). Moreover, the dielectric resonator may have a coil wound around itself (referring to FIG. 3D). By having the coil wound around the dielectric resonator, a dynamic frequency range can be lowered and the effect of the radiation can be reduced, and hence the efficiency of wireless power transmission and receipt can be improved. Furthermore, the loop antenna used for the dielectric resonator can have various shapes. As illustrated in FIG. 3E, a rectangular loop antenna may be used, but other shapes of the loop antenna are also available.

According to the current embodiment of the present invention, since a variety of forms can be employed for the dielectric resonator, it is possible to design a product that is most efficient. In other words, the shape and size of the dielectric resonator, which can be varied according to a desired dynamic frequency, allow easy application of the dielectric resonator to various products. Furthermore, various modifications of the dielectric resonator are possible to control the ratio of evanescent waves to radiation in a manner that helps obtain the most power transmission efficiency within a desired power transmission distance range.

Additionally, the shape of the dielectric resonator can be varied according to a desired frequency or characteristics of a terminal having a wireless power transmission or receipt function. Hence, the design of the dielectric resonator can be changed according to the intentions of a user.

Figure 4:
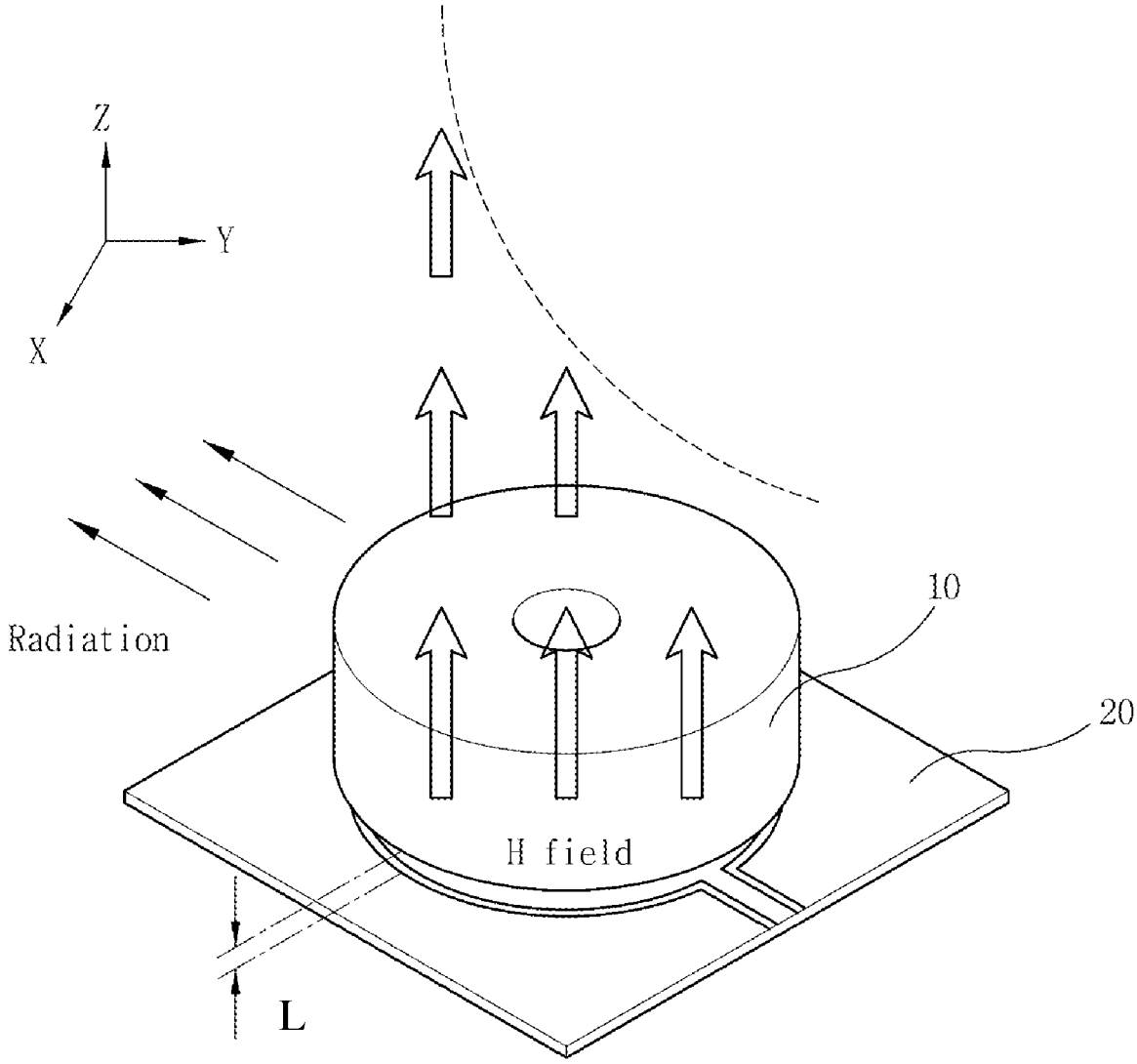
FIG. 4 shows a shape of a field which is formed when a signal is applied to the wireless power transmitting apparatus according to the embodiment of the present invention.

FIG. 4 shows a shape of a magnetic field H which is formed when a signal is applied to the wireless power transmitting apparatus according to the current embodiment of the present invention. Referring to FIG. 4, the field is formed when the signal is applied to the wireless power transmitting apparatus having the dielectric resonator 10 and the loop antenna 20 coupled to each other. Since the forms of the fields of the dielectric resonator and the loop antenna are similar to each other, resonance occurs inside the dielectric resonator. Outside the dielectric resonator, a cutoff mode is formed in a direction z so that the signal decays. At this time, the signal decays gradually, and thus it can be regarded as the occurrence of evanescent waves. The radiation occurs in directions x and y which are parallel to the top and bottom surface of the dielectric resonator 10. Also, in this, example, the loop antenna 20 is separated by a predetermined space 'L' from the bottom surface of the dielectric resonator 10.

A wireless power receiving apparatus according to an embodiment of the present invention is configured using the same structure as that of the wireless power transmitting apparatus described above. That is, the wireless power receiving apparatus comprises a dielectric resonator that receives power by receiving evanescent waves generated in a particular direction using a dielectric, and a loop antenna that is coupled to one surface of the dielectric resonator and receives power from the dielectric resonator. Since the structures of the dielectric resonator and the loop antenna have been already described above, a description of the structure of the wireless power receiving apparatus will be omitted.

Figure 5:
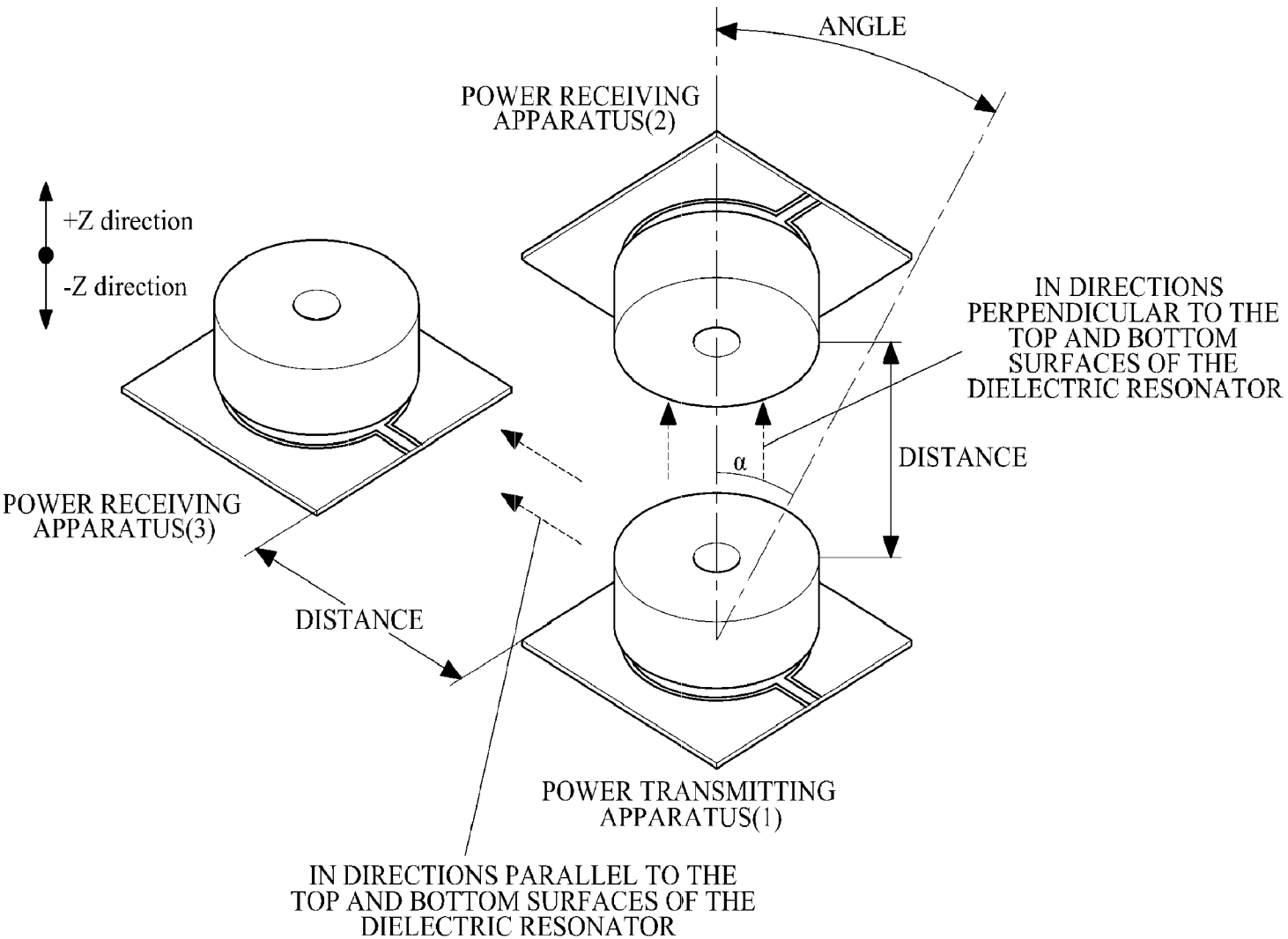
FIG. 5 illustrates a wireless power transmission and receipt system according to an embodiment of the present invention.

FIG. 5 illustrates a wireless power transmission and receipt system according to an embodiment of the present invention. Referring to FIG. 5, the wireless power transmission and receipt system includes a power transmitting apparatus 1 and a power receiving apparatus 2 or 3.

The power transmitting apparatus 1 transmits power from a power source through a loop antenna to the power receiving apparatus 2 or 3 using evanescent waves that are created by the dielectric resonator. The power transmitting apparatus 1 includes the dielectric resonator and the loop antenna which is coupled to a surface of the dielectric resonator.

The power receiving apparatus 2 or 3 receives power through the dielectric resonator using the evanescent waves generated by the power transmitting apparatus 1, and transmits the received power to a desired device through a loop antenna. The power receiving apparatus 2 includes a dielectric resonator and the loop antenna which is coupled to a surface of the dielectric resonator.

A structure for coupling the power transmitting apparatus 1 and the power receiving apparatus 2 or 3 is shown in FIG. 5. The dielectric resonator of the power receiving apparatus 2 is placed perpendicular to that of the power transmitting apparatus 1 and the dielectric resonator of the power receiving apparatus 3 is placed parallel to that of the power transmitting apparatus 1.

In a perpendicular arrangement, radiation does not occur in a direction z, and thus transmission through evanescent waves is possible. In a parallel arrangement, radiation occurs directly between distance apparatuses, and it is thereby possible to transmit the power to a distance apparatus through radiation or to transmit power to a close apparatus through radiation and evanescent waves.

In FIG. 5, it is more efficient for the power receiving apparatus 2 placed perpendicular to a top or a bottom surface of the power transmitting apparatus 1 to transmit and receive power using the evanescent waves created in both directions +z and −z which are perpendicular to the top and bottom surfaces of the dielectric resonator.

In the case of the power receiving apparatus 3 which is placed parallel to the top or bottom surface of the dielectric resonator of the power transmitting apparatus 1, it is more efficient to transmit power by radiation in a direction parallel to the top and bottom surface of the dielectric resonator of the power transmitting apparatus 1.

If the power receiving apparatus is placed at an angle between 0 and 90 degrees with respect to the dielectric resonator of the power transmission apparatus 1, evanescent waves may be used mostly to transmit and receive power between power transmitting and receiving apparatuses which are placed within a predetermined distance, and radiation may be used mostly to transmit and receive power between power transmitting and receiving apparatuses that are placed further apart than the predetermined distance. Moreover, the power transmitting and receiving efficiency of the power transmission apparatus 1 and the power receiving apparatus 2 or 3 increase as the resonant frequencies of each of the dielectric resonators become more similar to each other.

As described above, according to the present invention, a wireless power transmission apparatus efficiently transmits power using evanescent waves of a dielectric resonator.

Additionally, the dielectric resonator produces evanescent waves in a perpendicular direction and radiation in a horizontal direction, thereby enabling efficient power transmission according to a distance between the wireless power transmitting apparatus and the wireless power receiving apparatus. When the wireless power transmitting and receiving apparatuses are close to each other, strong coupling through the evanescent waves is achieved in a perpendicular direction, and as the wireless power transmitting and receiving apparatuses become further from each other, coupling by radiation becomes stronger in a horizontal direction. That is, in a short distance range, power transmission by the evanescent waves is more efficient than power transmission by radiation, and in a long distance range, power transmission occurs by evanescent waves along with radiation. Therefore, wireless power transmission can be efficiently performed in both long and short distance ranges.

Power transmission is performed using evanescent waves when the dielectric resonator is in a perpendicular position, and power transmission is performed by radiation when the dielectric resonator is in a horizontal position.

Furthermore, the resonator can have various shapes besides a cylinder shape, and thus the range of application of the dielectric resonator can be widened.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An apparatus for transmitting power wirelessly, the apparatus comprising:

a dielectric resonator which generates evanescent waves in directions perpendicular to a top surface and a bottom surface of the dielectric resonator in order to transmit power; and a loop antenna which is coupled to one of the top and the bottom surfaces of the dielectric resonator and supplies power to the dielectric resonator.

2. The apparatus of claim 1, wherein the dielectric resonator has either a cylinder shape, a cylinder shape with a hole in the center, or a rectangular parallelepiped shape.

3. The apparatus of claim 1, wherein the loop antenna is separated by a predetermined space from one of the top and the bottom surfaces of the dielectric resonator and, when power is applied to the loop antenna, an electromagnetic field is excited in the dielectric resonator to provide power to the dielectric resonator.

4. An apparatus for transmitting power wirelessly, the apparatus comprising:

a dielectric resonator which generates evanescent waves in predetermined direction in order to transmit power, wherein the dielectric resonator transmits relatively more power to a power receiving apparatus using evanescent waves than radiation when the dielectric resonator is within a predetermined range of distance from the power receiving apparatus and transmits relatively more power by radiation than by evanescent waves when a distance of the dielectric resonator from the power receiving apparatus exceeds the predetermined range; and a loop antenna which is coupled to a surface of the dielectric resonator and supplies power to the dielectric resonator.

5. A system for transmitting and receiving power wirelessly, the system comprising:

a power transmitting apparatus which includes a dielectric resonator and a loop antenna and transmits power provided from the loop antenna to a power receiving apparatus using evanescent waves generated by the dielectric resonator; and the power receiving apparatus which includes another dielectric resonator that receives the power using the evanescent waves generated by the power transmitting apparatus and another loop antenna that transmits the received power to an external device, wherein each of the power transmitting apparatus and the power receiving apparatus are formed by the respective dielectric resonator and the corresponding loop antenna which are coupled to each other, each of the power transmitting apparatus and the power receiving apparatus transmits and receives relatively more power using evanescent waves than radiation when each of the dielectric resonator is within a predetermined range of distance from each of the power transmitting apparatus and the power receiving apparatus, and transmits and receives relatively more power by radiation than by evanescent waves when a distance of each of the dielectric resonator from each of the power transmitting apparatus and the power receiving apparatus exceeds the predetermined range.

6. An apparatus for transmitting power wirelessly, the apparatus comprising:

a dielectric resonator which generates evanescent waves in predetermined direction in order to transmit power, wherein the dielectric resonator has a dielectric around which a coil is wound; and a loop antenna which is coupled to a surface of the dielectric resonator and supplies power to the dielectric resonator.

7. A system for transmitting and receiving power wirelessly, the system comprising:

a power transmitting apparatus which includes a dielectric resonator and a loop antenna and transmits power provided from the loop antenna to a power receiving apparatus using evanescent waves generated by the dielectric resonator; and the power receiving apparatus which includes another dielectric resonator that receives the power using the evanescent waves generated by the power transmitting apparatus and another loop antenna that transmits the received power to an external device, wherein each of the power transmitting apparatus and the power receiving apparatus are formed by the respective dielectric resonator and the corresponding loop antenna which are coupled to each other, and the power transmitting apparatus and the power receiving apparatus respectively transmit and receive power by radiation in directions parallel to top and bottom surfaces of each dielectric resonator.

8. An apparatus for transmitting power wirelessly, the apparatus comprising:

a dielectric resonator which generates evanescent waves in predetermined direction in order to transmit power; and a loop antenna which is coupled to a surface of the dielectric resonator and supplies power to the dielectric resonator, wherein the loop antenna is formed by patterning a loop-shaped antenna on a substrate.

9. The apparatus of claim 8, wherein a surface of the substrate on which the loop antenna is patterned is coupled to the surface of the dielectric resonator while an insulating layer is interposed between the surface of the substrate with the loop antenna pattern and the surface of the dielectric resonator.

10. The apparatus of claim 8, wherein a surface of the substrate opposite to the surface on which the loop antenna is patterned contacts the surface of the dielectric resonator to form the coupling.

11. An apparatus for receiving power wirelessly, the apparatus comprising:

a dielectric resonator which receives evanescent waves generated in a direction perpendicular to a top surface and a bottom surface of the dielectric resonator in order to receive power; and a loop antenna which is coupled to one of the top and bottom surfaces of the dielectric resonator and receives power from the dielectric resonator.

12. A system for transmitting and receiving power wirelessly, the system comprising:

a power transmitting apparatus which includes a dielectric resonator and a loop antenna and transmits power provided from the loop antenna to a power receiving apparatus using evanescent waves generated by the dielectric resonator; and the power receiving apparatus which includes another dielectric resonator that receives the power using the evanescent waves generated by the power transmitting apparatus and another loop antenna that transmits the received power to an external device, wherein each of the power transmitting apparatus and the power receiving apparatus are formed by the respective dielectric resonator and the corresponding loop antenna which are coupled to each other, and each dielectric resonator of the power transmitting apparatus and the power receiving apparatus respectively transmits and receives power using evanescent waves generated in directions perpendicular to top and bottom surfaces of each dielectric resonator.

13. An apparatus for transmitting power wirelessly, the apparatus comprising:

a dielectric resonator which performs power transmission by radiation in directions parallel to top and bottom surfaces of the dielectric resonator; and a loop antenna which is coupled to one of the top and the bottom surfaces of the dielectric resonator and supplies power to the dielectric resonator.

14. The apparatus of claim 13, wherein the dielectric resonator has at least one of a cylinder shape, a cylinder shape with a hole in the center, or a rectangular parallelepiped shape.

15. The apparatus of claim 13, wherein the loop antenna is separated by a predetermined space from a surface of the dielectric resonator and, when power is applied to the loop antenna, an electromagnetic field is excited in the dielectric resonator to provide power to the dielectric resonator.

16. A system for transmitting and receiving power wirelessly, the system comprising:

a power transmitting apparatus which includes a dielectric resonator and a loop antenna and transmits power provided from the loop antenna to a power receiving apparatus using evanescent waves generated by the dielectric resonator; and the power receiving apparatus which includes another dielectric resonator that receives the power using the evanescent waves generated by the power transmitting apparatus and another loop antenna that transmits the received power to an external device, wherein each of the power transmitting apparatus and the power receiving apparatus are formed by the respective dielectric resonator and the corresponding loop antenna which are coupled to each other, and the power transmitting and receiving efficiency increases as resonant frequencies of each dielectric resonator of the power transmitting apparatus and the power receiving apparatus become closer to each other.

17. An apparatus for receiving power wirelessly, the apparatus comprising:

a dielectric resonator which receives evanescent waves generated in a predetermined direction in order to receive power; and a loop antenna which is coupled to a surface of the dielectric resonator and receives power from the dielectric resonator, wherein the dielectric resonator includes a dielectric and a coil that is wound around the dielectric in order to reduce a dynamic frequency.

* * * * *